United States Patent [19]

Jones

[11] 4,359,092

[45] Nov. 16, 1982

[54] METHOD AND APPARATUS FOR NATURAL GAS AND THERMAL ENERGY PRODUCTION FROM AQUIFERS

[76] Inventor: Paul H. Jones, 3256 McConnell Dr., Baton Rouge, La. 70809

[21] Appl. No.: 85,988

[22] Filed: Oct. 18, 1979

Related U.S. Application Data

[63] Continuation-in-part of Ser. No. 960,631, Nov. 14, 1978, abandoned.

[51] Int. Cl.[3] ..... E21B 19/07; E21B 43/08; E21B 43/12; E21B 43/38

[52] U.S. Cl. ..... 166/265; 166/68; 166/74; 166/96; 166/233; 166/242; 166/370; 166/382

[58] Field of Search ..... 166/68, 72, 73, 75 R, 166/105.5, 233, 241, 242, 244 C, 265, 314

[56] References Cited

U.S. PATENT DOCUMENTS

| | | | |
|---|---|---|---|
| Re. 16,577 | 3/1927 | Crowell | 166/314 |
| 454,432 | 6/1891 | Heed | 166/314 X |
| 887,138 | 5/1908 | Stancliff | 166/233 |
| 1,083,018 | 12/1913 | Johnson | 166/314 |
| 1,754,945 | 4/1930 | Haskell | 166/314 |
| 2,077,912 | 4/1937 | Voorhis | 166/311 X |
| 2,167,338 | 7/1939 | Murcell | 166/75 R X |
| 2,858,893 | 11/1958 | Waggener | 166/75 R |
| 3,302,581 | 2/1967 | Burch | 166/265 X |
| 3,450,207 | 6/1969 | Hirsch | 166/233 |
| 3,638,731 | 2/1972 | Driscoll | 166/314 |
| 3,638,731 | 2/1972 | Driscoll | 166/314 |
| 3,743,355 | 7/1973 | Blackwell | 166/314 X |
| 4,014,387 | 3/1977 | Fink | 166/314 |
| 4,014,387 | 3/1977 | Fink | 166/314 |
| 4,019,576 | 4/1977 | Finch | 166/314 |
| 4,040,487 | 8/1977 | Cook, Jr. et al. | 166/314 |
| 4,057,108 | 11/1977 | Broussard | 166/242 X |
| 4,059,156 | 11/1977 | Berg | 166/314 |
| 4,116,276 | 9/1978 | Cook, Jr. et al. | 166/314 |
| 4,149,596 | 4/1979 | Richardson et al. | 166/314 X |
| 4,167,972 | 9/1979 | Sears | 166/233 |
| 4,199,028 | 4/1980 | Caughey | 166/314 |

OTHER PUBLICATIONS

Reeves, "Italian Oil and Gas Resources", American Association of Petroleum Geologists Bull., vol. 37, No. 4, 1953, pp. 625–628.

Buckley et al., "Distribution of Dissolved Hydrocarbons in Subsurface Waters," pp. 850–882, Habitat of Oil, L. C. Weeks Ed., American Association of Petroleum Geologists Special Publication, 1958.

Marsden et al., "Suiyosei-Ten'nengasu, A Special Type of Japanese Natural Gas Deposit," American Association of Petroleum Geologists Bull., vol. 49, No. 3, pp. 286–295, 1965.

Hammerlindl, "Predicting Gas Reserves in Abnormally Pressured Reservoirs", SPE preprint 3479, Society of Petroleum Engineers of AIME, Dallas, Texas, 1971.

Perry, "Statistical Study of Geopressured Reservoirs in Southwest Louisiana," SPE preprint 3888, Society of Petroleum Engineers of AIME, Dallas, Texas, 1972.

Sultanov et al., "Solubility of Methane in Water at High Temperatures and Pressures," Gazovaia Promphlennost, vol. 17, No. 5, pp. 6–7, May 1972.

Jones, "Geothermal and Hydrocarbon Regimes, Northern Gulf of Mexico Basin," pp. 15–89, Proceedings of the First Symposium on the Geopressure Geothermal Resources of the Gulf Basin, Austin, Texas: The University of Texas at Austin, 1975.

Jones, "Natural Gas Resources of the Geopressured Zones in the Northern Gulf of Mexico Basin," pp. 17–33, Commission on Natural Resources, National Academy of Sciences, Washington, D.C., 1976.

Isokrari, "Natural Gas Production from Geothermal Geopressured Aquifers," SPE preprint 6037, Society of Petroleum Engineers of AIME, Dallas, Texas, 1976.

Randolph, "Natural Gas from Geopressured Aquifers," SPE preprint 6826, Society of Petroleum Engineers of AIME, Dallas, Texas, 1977.

*Primary Examiner*—Stephen J. Novosad
*Assistant Examiner*—George A. Suchfield
*Attorney, Agent, or Firm*—Fleit & Jacobson

[57] ABSTRACT

Natural gas and thermal energy are produced from aquifers containing appreciable quantities of dissolved natural gas at or near saturation levels in the aquifer water, with or without associated dispersed vapor phase gas, using a particular method and apparatus.

36 Claims, 8 Drawing Figures

Solubility of methane in fresh water in the temperature range 30° to 360°C (86° to 680°F), at pressures of 600 to 16,000 psi.

(after Sultanov, Skripka, and Namiot, 1972)

Increase in the gas/water ratio of produced water with increase in the rate of flow.

Design of well to produce exsolved gas and geothermal water separately from geopressure zone reservoirs--early development phase.

Design of well to produce exsolved gas and geothermal water separately from geopressure zone reservoirs--following reversal of the gas/water permeability ratio.

Design of well to produce exsolved gas and geothermal water separately from hydropressure zone reservoirs.

Plan view of initial well field layout for production of natural gas and geothermal energy from aquifers containing methane-saturated waters.

Idealized pattern of mutual interference effects on head conditions in produced aquifer, 3 days, 10 days, and 30 days after discharge commences.

METHOD AND APPARATUS FOR NATURAL GAS AND THERMAL ENERGY PRODUCTION FROM AQUIFERS

RELATED APPLICATION

This application is a continuation-in-part of my earlier co-pending application, Ser. No. 960,631, filed Nov. 14, 1978, abandoned.

BACKGROUND OF THE INVENTION

1. Field of the Invention

This invention relates to a method and apparatus for creating natural gas reservoirs within geopressured or hydropressured aquifers which contain appreciable quantities of natural gas and producing the natural gas from the aquifers and simultaneously producing hot water for extraction of thermal energy, if desired.

2. Description of the Prior Art

Hydropressured aquifers are porous, permeable water bearing formations in which the interstitial fluid pressure reflects the weight of the superincumbent water column, unconfined above, and open to the atmosphere. The depth-pressure gradient is mainly a function of the dissolved solids content of the formation water, and may range from about 0.3 to about 0.5 pound per square inch per foot of depth.

Geopressured aquifers are not open to the atmosphere, having been compartmentalized by faulting, and their fluid pressures reflect a part of, or all of the weight of the superincumbent rock deposits. The depth-pressure gradient is mainly a function of rate of leakage, or fluid escape, from the aquifer system, and may range from about 0.5 to about 1.0 pound per square inch per foot of depth.

Geopressured aquifers exist along the Gulf Coast of the United States and in many other places throughout the world where sedimentary deposits have been rapidly buried. Due to the high pressures found in geopressured aquifers, if a well is drilled into the aquifer, water will flow to the surface of the ground in artesian fashion.

Natural gas may be present in geopressured or hydropressured aquifers in any of these forms:

(1) Gas dissolved in the water, (2) Free gas dispersed in water within the rock pores, and (3) A free gas phase present within the rock pores and separate from the water.

The natural gas contained in aquifers is commonly 95–98% or more methane.

The conventional method of producing hydrocarbon fluids from oil and gas wells is designed to restrict the flow rate so as not to reduce drastically the pressure in the vicinity of the production well and draw water into the well. In order to do this, the well completion is in a zone above the oil-water or gas-water contact. Conventionally, gas wells cease production when water invades the area near the well bore and appreciable quantities of water are produced with the gas.

Publications which relates to the background of this invention and which are referred to herein are as follows.

1.—Reeves, "Italian Oil and Gas Resources," American Association of Petroleum Geologists Bull., v. 37, no. 4, Pp. 625–628, 1953

2.—Buckley, et al, "Distribution of Dissolved Hydrocarbons in Subsurface Waters," Pp. 850–882, "Habitat of Oil", L. C. Weeks Ed., American Association of Petroleum Geologists Special Publication, 1958

3.—Marsden and Kawai, "Suiyosei-Ten'nengasu, A Special Type of Japanese Natural Gas Deposit," American Association of Petroleum Geologists Bull., v. 49, no. 3, Pp. 286–295, 1965

4.—Hammerlindl, "Predicting Gas Reserves in Abnormally Pressured Reservoirs," SPE preprint 3479, 6 p., 4 figs: Society of Petroleum Engineers of AIME, Dallas, Tex., 1971

5.—Perry, "Statistical Study of Geopressured Reservoirs in Southwest Louisiana," SPE preprint 3888, 3 p., 4 tables, 6 figs: Society of Petroleum Engineers of AIME, Dallas, Tex., 1972

6.—Sultanov, et al, "Solubility of Methane in Water at High Temperatures and Pressures," Gazovaia promphlennost, v. 17, no. 5, Pp. 6–7, May 1972

7.—Jones, "Geothermal and Hydrocarbon Regimes, Northern Gulf of Mexico Basin," Pp. 15–89 Proceedings of the First Symposium on the Geopressured Geothermal Resources of the Gulf Basin, Austin, Tex.: The University of Texas at Austin, 1975

8.—Jones, "Natural Gas Resources of the Geopressured Zones in the Northern Gulf of Mexico Basin," Pp. 17–33, Natural Gas from Unconventional Geologic Sources, Board on Mineral Resources, Commission on Natural Resources, National Academy of Sciences, Washington, D.C., 1976

9.—Isokrari, "Natural Gas Production from Geothermal Geopressured Aquifers," SPE preprint 6073, 9 p., 6 tables, 18 figs: Society of Petroleum Engineers of AIME, Dallas, Tex., 1976

10.—Randolph, "Natural Gas from Geopressured Aquifers," SPE preprint 6826, 8 p., 1 table, 8 figs: Society of Petroleum Engineers of AIME, Dallas, Tex., 1977

Commercial development of natural gas dissolved in saline formation waters began in the Tokyo Bay region of Japan in 1931, from wells ranging up to 400 m (1312 ft) deep, and is now established in more than a dozen fields scattered throughout Japan (Marsden and Kawai, 1965). Production in 1963 was about $1.69\times10^9 m^3$ ($58.68\times10^6$, mcf). This dry gas is in no way associated with crude oil and is an entirely separate resource. Although some production comes from depths as great as 2,000 m (6,560 ft), most production is from depths less than 1,000 m (3,280 ft). Individual wells yield up to 6,000 $m^3$ (208,000 cf) per day, with gas-water ratios up to about 11 cf/bbl. Well diameters are generally no larger than 5 inches, and well life ranges from about 5 to 10 years, failure being attributed mainly to corrosion. All of the produced methane now goes to the chemical industry.

Commercial development of dissolved natural gas began in Italy in the eastern part of the Po delta, northeast of Ferrara, Italy, in 1939 (Reeves, 1953), from wells limited by law to depths less than 500 m (1,640 ft). This Polesine gas producing area occupies about 2,000 $km^2$ (about 770 $mi^2$). In 1951, 1,400 wells were producing about $753\times10^6 m^3$ ($26.1\times10^6$ mcf), about 34 percent of Italy's total annular production of natural gas. From 1943 to 1949, this area produced more natural gas than all other fields in Italy. Wells usually flow for a few years, and then must be pumped. The ultimate yield before failure is about 600,000 to 800,000 $m^3$ (20,833 mcf to 27,700 mcf).

Gas-depleted salt water is discharged by canal or saline estuary to the sea, in both Japan and Italy. Contamination of farm lands by leaky canals has occurred in both countries, and land subsidence as a consequence of withdrawals has resulted in curtailment of production in some areas in both countries. Poor equipment, faulty technology, and haphazard operations have led to serious problems and small profit margins in both Italy and Japan.

An investigation of the natural gas content of subsurface waters was made by Humble Oil and Refining Company (now Exxon USA) during the middle 1940's (Buckely et al, 1958). Water samples were collected by specially-designed downhole tools and carefully analyzed in the laboratory. Samples were taken from some 300 wells distributed from New Mexico to Florida, but concentrated primarily in East Texas, the upper Gulf Coast of Texas, and southern Mississippi. The primary objective of this investigation was to discover whether or not dissolved gaseous hydrocarbons exist generally in subsurface waters, and, if they do, to determine the extent of their distribution and the manner in which the distribution might be affected locally by accumulations of oil or gas in the same formation, in deeper formations, or in shallower formations. Results show that at depths below a few thousands of feet, saline formaton waters contain measurable amounts of dissolved natural gas, primarily methane; that the natural gas/methane content generally increases with depth; that in formations older than the Oligocene in the areas and depth ranges studied, percent saturation in natural gas is generally only a few percent; and that "throughout the region sampled, the Frio (Oligocene) water was found to be either saturated or nearly saturated with dissolved gas in nearly every well sampled. The total quantity of gas dissolved in the water of the subsurface formations in this area probably exceeds the known proved gas reserves heretofore discovered in commercial accumulations in the area." (Pp. 881–882).

Source wells for water-flood operations in two tracts of the outer continental shelf, Gulf of Mexico, ranging in depth from about 1,400 to about 6,000 ft, yield formation water saturated in natural gas, primarily methane. Four wells, 3,200 to about 6,000 ft deep, are located in Grand Isle Bl. 16, operated by Exxon, USA; one well about 1,400 ft deep, located in Eugene Island Area Bl. 331, is operated by Shell Oil Company. Dissolved gas content is 14 to 16 cf/bbl, in water produced. Many thousands of drill-stem tests, as well as innumerable Schlumberger wire-line formation tests, confirm the presence of natural gas, primarily methane at or near saturation in saline-water aquifers throughout coastal Louisiana and Texas, onshore and offshore, below depths of a few thousands of feet.

The very great solubility of methane in water at high pressures and temperatures, as shown in FIG. 1 (Sultanov et al, 1972), and the abundant evidence for methane saturation of saline formation waters between depths of 1,400 and 20,000 ft or more, support the claim of this patent that natural gas can be produced from saline water aquifers in this depth range, in geologically young sedimentary basins in which petroleum hydrocarbons are in the process of maturation, such as the northern Gulf of Mexico basin. The dissolved methane can be produced with water discharged from wells tapping the aquifers, as in Japan and Italy, or separately from the produced water by methods described in this patent.

The amount of gas released from solution with incremental reductions of fluid pressure and/or temperature are indicated in Table 1.

TABLE 1

Solubility of methane in water at selected temperatures and pressures, in standard cubic feet per barrel. (values approximate)

| Pressure | Temperature °F. | | | | | |
|---|---|---|---|---|---|---|
| psi | 200 | 300 | 400 | 500 | 600 | 656 |
| 2,000 | 10 | 12 | 20 | 30 | 17 | |
| 3,000 | 13 | 17 | 30 | 52 | 80 | |
| 4,000 | 15 | 23 | 40 | 76 | 135 | |
| 6,000 | 20 | 29 | 52 | 105 | 230 | 380 |
| 8,000 | 24 | 35 | 64 | 130 | 285 | 440 |
| 10,000 | 28 | 41 | 77 | 149 | 340 | 620 |
| 12,000 | | 47 | 86 | 168 | 400 | 800 |
| 14,000 | | 53 | 95 | 186 | 440 | 900 |
| 16,000 | | 58 | 104 | 200 | 480 | 1,000 |

These data and the curves in FIG. 1 support the observation of Perry (1972) that "the larger percentage of economical reserves (found to occur) at the higher pressure gradients reverses the previous concepts that geopressured reservoirs would contain small volumes of reserves." Unit decline of fluid pressure releases far greater amounts of gas (from water solution) at pressures between 4,000 and 12,000 psi, and at temperatures above 300° F., than at lower pressures and temperatures. At 400° F., volumes released by unit pressure drop are double those at 300° F.; at 500° F., they are quadruple; and at 600° F., they are an order of magnitude greater. Such releases of dissolved methane from high-temperature, high-pressure water associated with abnormally pressured (geopressured) natural gas reservoirs in believed to explain the two distinct slopes evident in plots of shut-in bottom-hole pressures versus cumulative production (P/Z plot). Hammerlindl (1971) explains this change of slope, initially gentle and later steep, as the combined effect of changes due to gas expansion, formation compaction, crystal (rock) expansion, and water expansion. No mention is made of the effects of dissolved gas exsolution.

The origin of the nonassociated natural gas in geopressured gas reservoirs of the Gulf Basin—6,600 of which produced some 6 Tcf of natural gas in Louisiana in 1977—is discussed by Jones (1975), who attributes the gas to natural thermal cracking of all petroleum that fails to escape from the geopressure zone, supersaturating the associated formation waters. Jones has estimated (1976) that the dissolved natural gas resource of the northern Gulf of Mexico basin, in geopressured sand-bed aquifers beneath an area of some 150,000 $mi^2$, and above a depth of 25,000 ft, is about 49,000 Tcf. Isokrari (1976), on the basis of computer studies of the production of multiphase fluids (natural gas, gas in solution, and water) concludes that water wells completed in geopressured reservoirs would be capable of delivering as much natural gas per day as many conventional gas wells. "Parametric studies of cost of producing natural gas as the value of individual reservoir parameters is varied reveal maximum sensitivity to those parameters most difficult to quantify," according to Randolph (1977), who concludes that (1) Reservoir criteria for natural gas production are much less stringent than for electricity generation from geopressured Gulf Coast aquifers, and (2) Large quantities of natural gas may be producible at a cost competitive with alternative sources from aquifers whose producing characteristics are sub-marginal for supporting investment in facilities to generate electricity from thermal and mechanical energy.

In Jones (publication 8 above), I describe the basic principles upon which the present invention is based. More particularly, I disclose that natural gas contained in the waters of geopressured and hydropressured aquifers of the northern Gulf of Mexico basin can be recovered by withdrawing water from the aquifer. Withdrawal of the water reduces the pressure within the aquifer and thus causes the natural gas originally dissolved in the water at or near saturation levels to exsolve from the water and commence free flow to form a gas cap. The gas is then capable of being withdrawn or recovered from the aquifer essentially water-free. Recovery of the exsolved gas and continued removal of the water causes further exsolution of additional quantities of dissolved gas which allows for continuous recovery of water-free gas (except for water vapor). This process continues until most of the dissolved gas has exsolved. However, no method or apparatus is disclosed for accomplising the withdrawal of the aquifer water to cause gas flow and permit simultaneous recovery of the water-free gas.

Patents considered related to this invention are as follows (in descending order of estimated relevancy).

U.S. Pat. Nos. 4,040,487 and 4,042,034 have identical specifications and drawings, and both relate to a process for producing natural gas which is unrecoverable by conventional methods. In applying the method to an appropriate geopressured reservoir, water is produced at a rate sufficient to lower the aquifer pressure and thereby release gas which will migrate and be produced. It is disclosed that it is desirable and necessary to produce water from wells at a very high production rate so as to reduce the formation pressure significantly and preferably as quickly as possible throughout as large an extent of the aquifer as possible. Due to this lowering of the aquifer pressure, gas will be released from solution with the water, will expand and join either the free gas phase dispersed in the water within the sand pores or the free gas present in a gas cap. It may even form a new gas cap if far enough removed from the well so that gravitational forces overcome differential pressure forces which normally cause the gas to flow toward the well. Because natural gas flows more easily through a porous formation than does water, gas will migrate if concentrations greater than residual gas exist. The residual gas concentration will be joined by released gas or expanded gas in the reservoir, and will come to the well bore to be produced with the water which also contains its solution gas. If the producing well is located in a formation close to a free gas phase attic, the lowering of the aquifer pressure can also cause the attic gas to expand and be produced at the well bore as the gas displaces the water and cones into the producing well. Condensate contained in the attic gas would additionally be produced along with the water and gas. A free gas cap remote from the producing well may be created or enlarged and it may be prudent to produce these areas in order to increase gas recovery from the reservoir and thereby to extract the maximum quantity of gas from it.

The reserves of gas contained in geopressured aquifers are speculative due to the scarcity of data regarding the aquifer location, size and gas concentration. It is probable that the first targets for producing gas using the method of U.S. Pat. Nos. 4,040,487 and 4,042,034 will be geopressured water drive gas reservoirs which have been produced to the maximum extent with conventional methods. The principal reason for choosing this type of reservoir is that there is a known free gas phase dispersed in the water within the rock pores and a known degree of geopressure. Additionally, the presence of existing wells which can be used for producing water or injecting it into shallower sands will enhance the economics of such a project. A second type of reservoir which is a candidate for this method is a geopressured reservoir which has indicated free gas on logs, which would not produce water-free.

An ideal candidate reservoir for gas production by this method should have:

(1) A high degree of geopressure and strong water drive.

(2) A moderate resistance to the flow of water and gas through a range of permeability from 30 to 200 millidarcies.

(3) A history of produced gas, i.e. a free gas phase dispersed in water within the pores of the rock.

(4) Existing gas wells in the formation which are still usable for either production or reinjection of water.

(5) A shallow salt water formation for disposal of produced water.

(6) Attic gas upstructure in the reservoir, remaining after cessation of production by conventional means.

(7) A high condensate to gas ratio in the attic.

U.S. Pat. Nos. 3,258,069 and 3,330,356, relate to a method and apparatus, respectively, for tapping the aqueous liquids in geopressured aquifers. There is no mention of dissolved hydrocarbons.

U.S. Pat. No. 3,330,356 is a continuation-in-part of U.S. Pat. No. 3,258,069, and further discloses the recovery of petroleum light hydrocarbons, contained in the aqueous liquids brought up to the well head.

Other patents which are known, but which appear to be less relevant than the above, include the following (in numerical order).

U.S. Pat. No. 1,272,625 relates to oil wells, which may contain gas. There is a disclosure of a coaxial inner tube, and the separation of the oil from the gas, but not in an analogous manner to the subject invention.

U.S. Pat. No. 2,077,912 relates to gas wells. There is a discussion of prior art and methods for removal of undesirable water and a disclosure of removing only the gas from a flooded well, using a coaxial tube and a removable submerged plug.

U.S. Pat. No. 2,230,001 relates to oil wells. It discloses tapping water in a separate well from a separate stratum, compressing and filtering the water above ground, and pumping it into an oil well under pressure, using a coaxial tube.

U.S. Pat. No. 2,258,615 relates to oil wells containing water. It discloses introducing crude oil into the oil well, to stratify the oil and water, using a coaxial tube.

U.S. Pat. No. 2,736,381 relates to wells containing normally liquid hydrocarbons (oil) in a gaseous phase, mixed with methane. It discloses using two wells: the first connecting a high pressure stratum with a lower pressure upper stratum, and sealed at the well head; the second tapping the lower pressure stratum, whose pressure is increased by the first well. There is no water removal.

U.S. Pat. No. 2,760,578 relates to obtaining oil and gas from different strata. It discloses a removable inner flow tube which may be raised or lowered, with oil going up the main bore and gas up the tube, or the reverse.

U.S. Pat. No. 3,123,134 relates to oil wells. It discloses a method of recovering additional oil from watered-out reservoirs by gas injection into surrounding wells.

U.S. Pat. No. 3,134,438 relates to oil wells. It discloses an inner tube inside a well, but for a different purpose and used differently from the subject invention.

U.S. Pat. No. 3,177,940 relates to a method for obtaining fresh water from brine, using a well with an inner tube.

U.S. Pat. No. 3,215,198 relates to gas wells. It discloses a method for pressure maintenance by gas injection.

U.S. Pat. No. 3,302,581 relates to gas wells. It discloses water removal by the use of a collapsible plug injected into the well, which is lifted by the gas pressure.

SUMMARY OF THE INVENTION

Methods and apparatus are provided for creating and producing natural gas reservoirs in aquifiers which contain natural gas at saturation levels, and for simultaneously producing the hot aquifer water for extraction of geothermal energy, if desired. The special advantages of the methods described are (1) the natural gas is produced water-free (except for water vapor) at the well head, at rates far in excess of those possible by extraction from water-gas mixtures discharged from wells of conventional design; (2) heat losses from exsolution and expansion of natural gas in the water as it rises in the well bore and passes through turbines and/or heat exchangers at the land surface are minimized; (3) most of the heat required for exsolution and lost in expansion of the natural gas as it moves to the well bore is supplied by the aquifer rock matrix of the gas reservoir; (4) the mechanical efficiency of fluid-handling equipment is much improved; (5) gas-depleted geothermal waters of the reservoir can be produced subsequently through the same wells, at well-head temperatures only slightly below reservoir temperatures.

Special requirements are (1) areally extensive aquifers preferably 100 ft or more in thickness and reasonably homogeneous and isotropic, (2) wells of special design, as disclosed herein, based upon results of aquifer studies and hydraulic tests made using preferrably 3 to 5 pilot wells, (3) well fields in which well location and well spacing are based upon results of hydraulic tests of the pilot well field, and fluid withdrawal rates are designed to produce predetermined patterns of head decline in the produced aquifer, and (4) uninterrupted production from all wells in the development scheme, once operations have begun.

The methods of this invention are applicable most readily to geopressured geothermal aquifers, but may also be used effectively, with proper well design and pumping equipment, on hydropressure zone aquifers. The methods are based upon well-known physical principles of aquifer hydraulics, of multi-phase flow, of the thermodynamics of fluids, and of the hydraulics of wells. Hydrodynamically induced reduction of interstitial fluid pressure in gas-saturated aquifer waters, or near-saturated waters, resulting from withdrawal of water at predetermined rates from carefully-engineered well fields, will cause dissolved gas to come out of water solution as dispersed gas bubbles, in a predetermined area. Continuing withdrawals cause progressive reduction of fluid pressure, progressive exsolution of gas, and progressive expansion of exsolved gas. As the percent of the pore space occupied by gas exceeds a variable critical value between about 6% to 60% depending largely upon the composition, texture, and cementation of the aquifer matrix, the gas/water permeability ratio is reversed. Gas flow quickly dominates the system, and water flow is greatly reduced and may be essentially stopped. This critical value is called the "critical gas saturation" and is the minimum percent of the aquifer pore space which must be occupied by dispersed (vapor phase) gas for gas phase flow to occur. In a typical aquifer, the pore space unoccupied by rock comprises about 10–25% of the total space. Dispersed natural gas may occupy 2–4% of the pore space, or less. As water is withdrawn, dissolved gas exsolves and dispersed gas, if any, expands so that the percent of pore space occupied by dispersed gas increases. When this percent reaches the critical gas saturation value for the aquifer, the gas/water permeability ratio reverses and free gas flow to the well commences.

As indicated, the depth and make-up of the aquifer determine the critical gas saturation value for the particular aquifer. At greater depths, the critical gas saturation is normally higher. The configuration of the pores also significantly affects the critical gas saturation for a particular aquifer. Other factors that may have an effect are temperature and water salinity, for example. A typical aquifer on the northern Gulf of Mexico basin at 10,000 feet to which the present invention is suitable might have a critical gas saturation range of 30–50%. However, aquifers with a lower critical gas saturation in the lower end of the 6–60% range would permit more rapid conversion to free gas flow. The critical gas saturation value can usually be determined from test cores of the aquifer in question.

In accordance with the present invention, it is believed necessary to reduce the hydraulic head (pressure) in the aquifer by about 30–50%. In deeper aquifers, the reduction of pressure is proportionately less to achieve the requisite gas saturation. At lesser depths, more pressure reduction is required. For example, at depths less than 8,000 feet, it is believed that at least 50% reduction of the aquifer pressure may be required in order to achieve critical gas saturation and cause vapor phase flow. As the aquifer depth increases, the necessary percent reduction reduces.

Concurrently with the shift to vapor phase flow, the cone of pressure relief created by the fluid withdrawals spreads very rapidly, as the permeability of reservoir rock to gas is generally an order of magnitude, or more, greater than it is to water. As this occurs, the rate of gas discharge increases markedly, and wells within the boundaries of the newly-created gas reservoir will flow natural gas and water vapor. This condition is sustained as long as the expanding cone of pressure relief continues to cause gas exsolution at appreciable rates from aquifer waters. Two factors combine to cause a progressive decline in the rate of gas production from the created gas reservoir, (1) depletion of the dissolved gas content of aquifer waters within the cone of pressure relief, and (2) increasing distance (radial travel path) of the zone of exsolution to the discharge points (wells). Unless new wells within the area of the created gas reservoir, at an optimum distance from the initial production wells, can now be opened and produced, the artificial gas reservoir will gradually collapse: the initial production wells will water out, and their produced water will contain only residual amounts of dissolved gas.

The apparatus of this invention differs from a conventional well in that there is provided an eductor pipe within the well which can remove saline water from the aquifer which is admitted through a sand screen that is located at the bottom of the well in a known manner. The intake end of the eductor pipe is maintained below the gas/water interface inside the well screen after gas-phase flow to the well has been induced. Natural gas enters the well through the remaining (upper) portion of the well screen and rises through the annulus between the exterior of the eductor pipe and the inner surface of the well casing. The eductor pipe can be made of, or coated with, a thermal insulation material, so that the temperature of the geothermal liquid inside it is minimally affected by the heat absorption resulting from the expansion of the natural gas as it rises through the annulus, if the thermal energy is to be recovered. Preferably, a means for raising and lowering the eductor pipe is provided, so that its bottom end can be adjusted. Additionally, a submersible pump can be positioned within the eductor pipe in order to assist withdrawal of the aquifer waters to the well head.

DESCRIPTION OF THE PREFERRED EMBODIMENTS

This invention is directed towards (1) production of natural gas and geothermal energy from natural gas saturated or near-saturated formation waters at large flow rates and high thermal efficiency; (2) separation of gas and water phases as they enter the well bore, to the extent possible; and (3) conveyance of the gas and hot water flows to the well head (land surface) separately, the gas through an annulus between the well casing and a water eductor pipe, and the hot saline water through the eductor pipe, which is preferably coated to reduce friction and prevent corrosion. The eductor pipe is supported at the well head to allow changing the depth setting without shutting in the well, or restricting the discharge of fluids from the well. This permits the bottom or inlet end of the eductor pipe to be maintained below the gas-water interface at the bottom of the well or raised to allow gas flow into the eductor pipe under maximum gas yield conditions.

Figure 6:
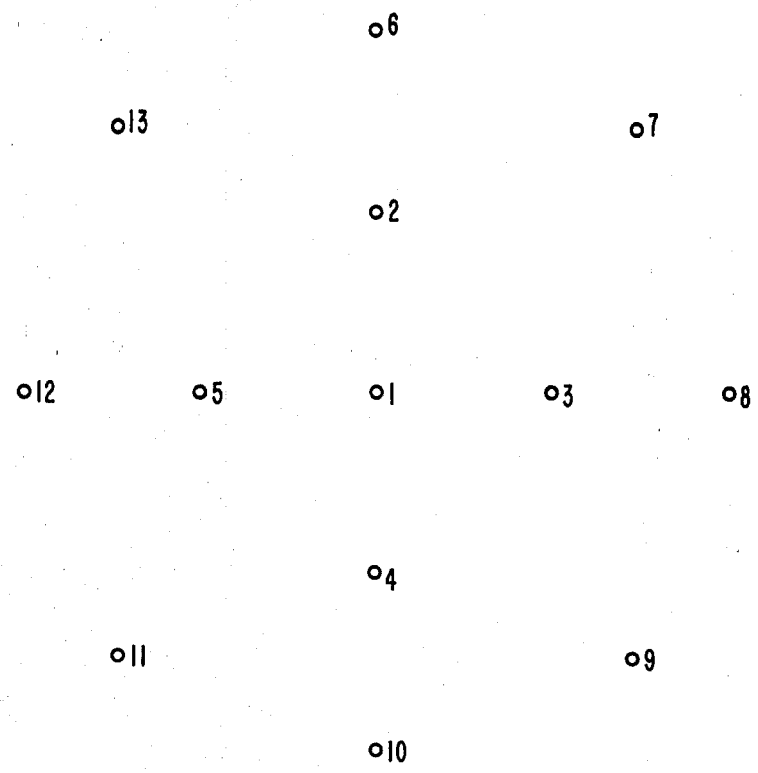
FIG. 6 is a plan view of the initial well field layout for production of natural gas and geothermal energy from aquifers containing substantial quantities of natural gas.
Figure 7:
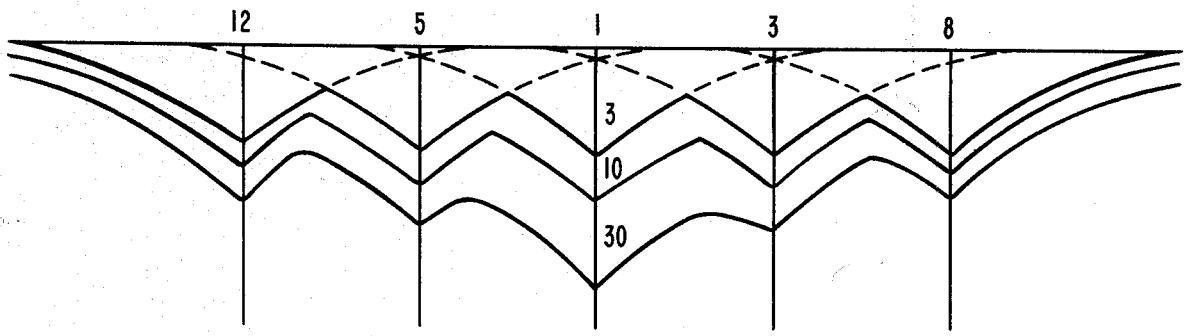
FIG. 7 is an idealized pattern of mutual interference effects on head conditions in a produced aquifer, 3 days, 10 days, and 30 days after discharge is commenced.

The present invention can be applied in the recovery of dissolved or dispersed natural gas and geothermal energy from reservoirs in either the geopressure zone or the hydropressure zone. For hydropressure zone development, larger diameter well casings are required, and the well may be fitted with a submersible pump. Well fields are designed to effect mutual hydraulic interference between discharging wells, as shown in FIGS. 6 and 7, to accomplish large reduction of formation fluid pressure with consequent increases in gas exsolution.

It is believed that my present invention is based mainly on two conceptual principles. First, the physics of flow of a multiphase fluid (water and gas) in an aquifer system stressed by steep gradients in hydraulic head (pressure) involves three dimensional transients in gas/water ratios, gas/water permeability distributions, and dissolved gas contents, all related to the direction an steepness of the hydraulic gradient. Once these transients are generated by discharging wells, and the resulting flow rates, gradients in head, and fluid pressure regimes in the aquifer have become reasonably stabilized, a systematic dissolved gas extraction pattern is established that leads to maximum recovery of dissolved gas. Marked reduction in the rate of fluid discharge from the well or well field, or a cessation of discharge, will collapse the stress field, and a permanent loss of dissolved gas recoverability will result. It is believed most critical to this invention, that once well discharge has begun in a given setting, it should not cease or be interrupted more than briefly, until the dissolved gas recovery is complete.

Second, natural gas reservoirs produced for periods of many years remain essentially isothermal. This means that heat losses are small as a consequence of water vaporization and natural gas exsolution with continuing decline of reservoir pressure, or that the stored heat of reservoir rock offsets these losses to the extent that little change in reservoir temperature occurs. It also means that significant temperature change (lowering) in the produced fluid (gas) stream must occur going up the well bore. Long experience with wells flowing water at moderate to high rates from reservoirs at great depth shows little or no change in the temperature of the water going up the well bore. Gas wells, on the other hand, are refrigerating systems during operation; ice coatings on well-head equipment are common. Gas expansion going up the well bore requires heat. Separation of the gas flow from the water flow, as described in this patent, is designed to preserve the heat energy of the geothermal water.

More specifically, this invention is a method and apparatus to providing for continuous natural gas production from hydropressure or geopressure aquifers containing water having large quantities of natural gas dissolved or dispersed therein at saturation or near-saturation levels. Additional quantities of natural gas may be, but not necessarily are present in an associated gas cap. Also, liquid hydrocarbons might be present for recovery. In the method of this invention, a well is drilled into the gas-saturated aquifer. The well may be constructed with a conventional liner and casing up to the point at which the bore enters the aquifer. The portion of the well bore penetrating into the aquifer is completed with a screen instead of a perforated liner.

The screen is of the type conventional for water wells in sand aquifers, but is usually not employed in oil or gas wells, except when serious sanding problems exist. Such a screen typically comprises a wire-wrapped perforated pipe in which 40 to 60 percent of the surface area is removed by equally spaced drill holes, generally $\frac{1}{4}$ to $\frac{3}{4}$ inches in diameter. The pipe is fitted with evenly spaced longitudinal stringers on the outside. The body of the pipe is wrapped with a winding of trapezoidally cross-sectioned wire, placed so that the base of the trapezoid is on the outside, and spaced apart so that the slot formed between the windings is sufficient to pass only the 70% fines of the sand. This screen acts to permit the gas-water liquid and the gas of the aquifer to enter into the well, without admitting sufficient sand particles to clog the well.

The well also contains an eductor pipe used primarily for the removal of water. This eductor pipe should preferably be no smaller than about 8 inches in internal diameter and can be as large as up to about 10 inches in internal diameter, or even slightly larger. The inner diameter of the well casing and liner is preferably larger than that conventional for gas wells, preferably 2 or more inches larger than the outside diameter of the eductor pipe, in order to allow enough space in the annulus between the eductor pipe and the casing to permit the free flow of gas.

Figure 5:
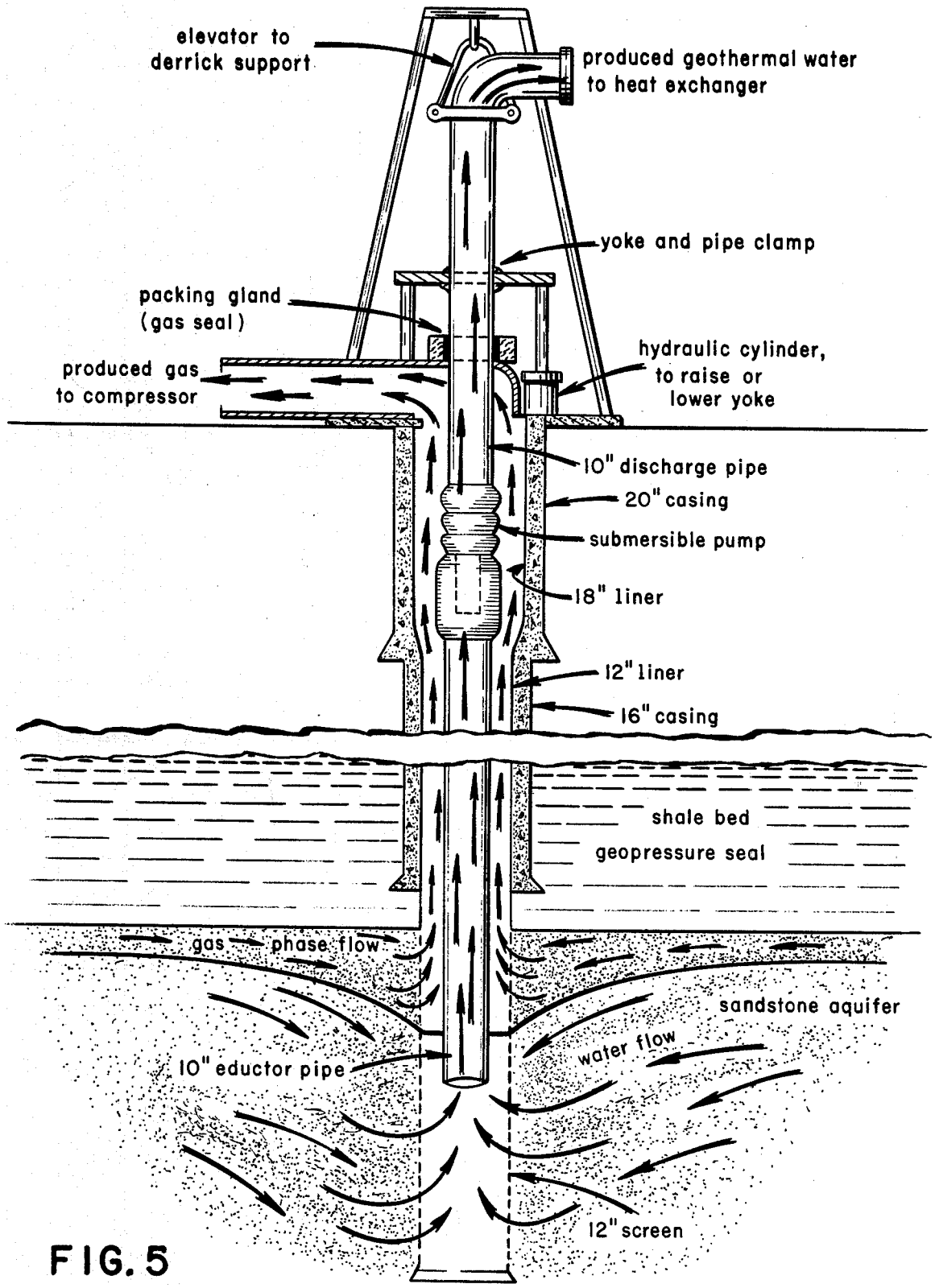
FIG. 5 is a design of a well to produce exsolved gas and geothermal water separately, from hydropressure zone reservoirs or developed geopressured aquifers needing pump assistance to lift the aquifer waters to the well surface.
Figure 8:
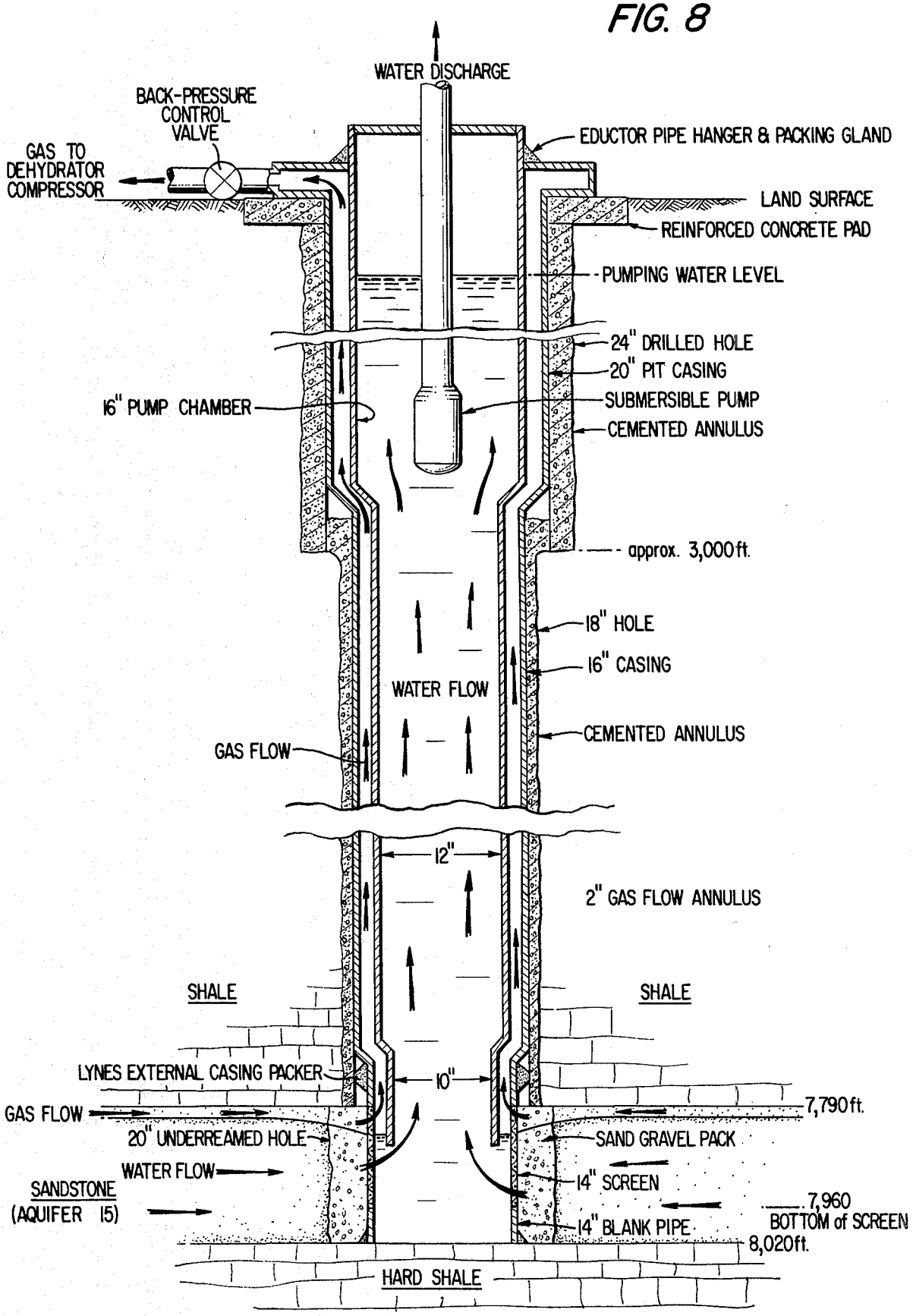
FIG. 8 is a modified design from FIG. 5 and permits recovery of exsolved gas and geothermal water separately from either geopressured or hydropressured zone reservoirs.

In some cicumstances, especially where the well is drilled into a hydropressure zone aquifer, it may be desirable to include pumping means operatively associated with the eductor pipe, which may be located at the well head or may be located at a point along the eductor pipe beneath the well head in the form of a submersible pump (see FIGS. 5 and 8). As shown in FIG. 8, the pumping means can be supported independently within the eductor pipe. Submersible pumps are themselves conventional, and are typically used in water wells which do not have sufficient hydropressure to flow at the land surface. They are preferred in hydropressure gas wells because of the lower water pressure frequently encountered, and the deep pump settings necessary. Typical of useful submersible pumps are those supplied by the Byron Jackson Pump Division of Borg Warner Corporation.

Figure 1:
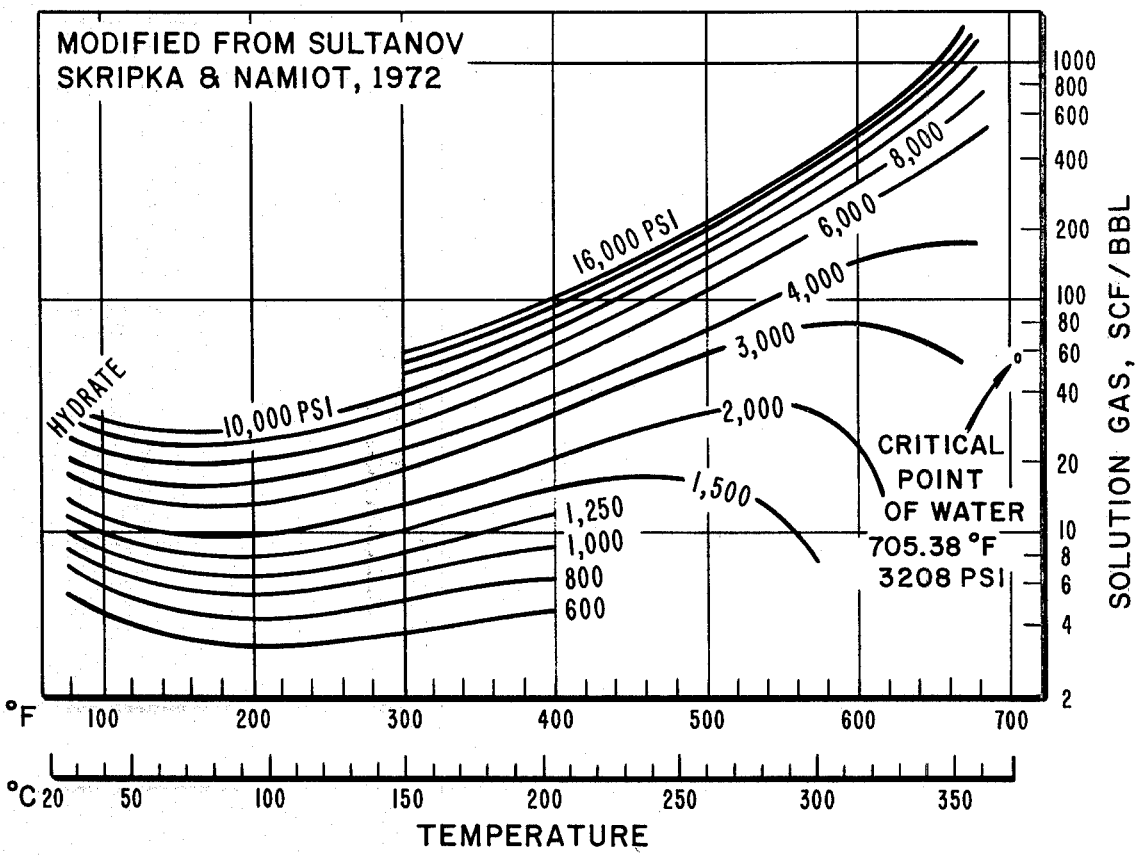
FIG. 1 is solubility curves for methane in fresh water in the temperature range 30° to 360° C. (86° to 680° F.), and at pressures of 600 to 16,000 psi.
Figure 2:
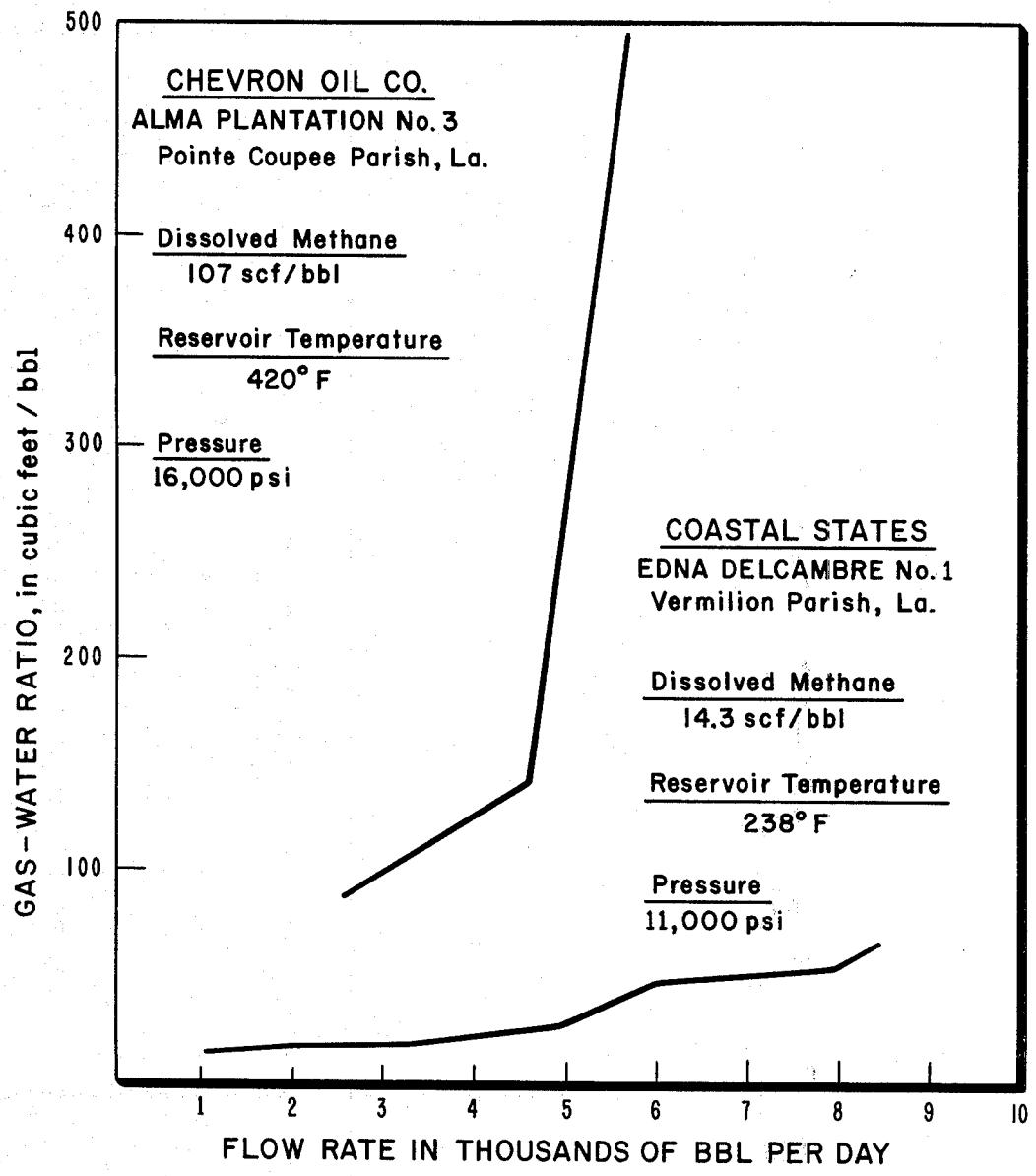
FIG. 2 shows the increase in gas/water ratio of produced water with increase in the rate of flow.
Figure 3:
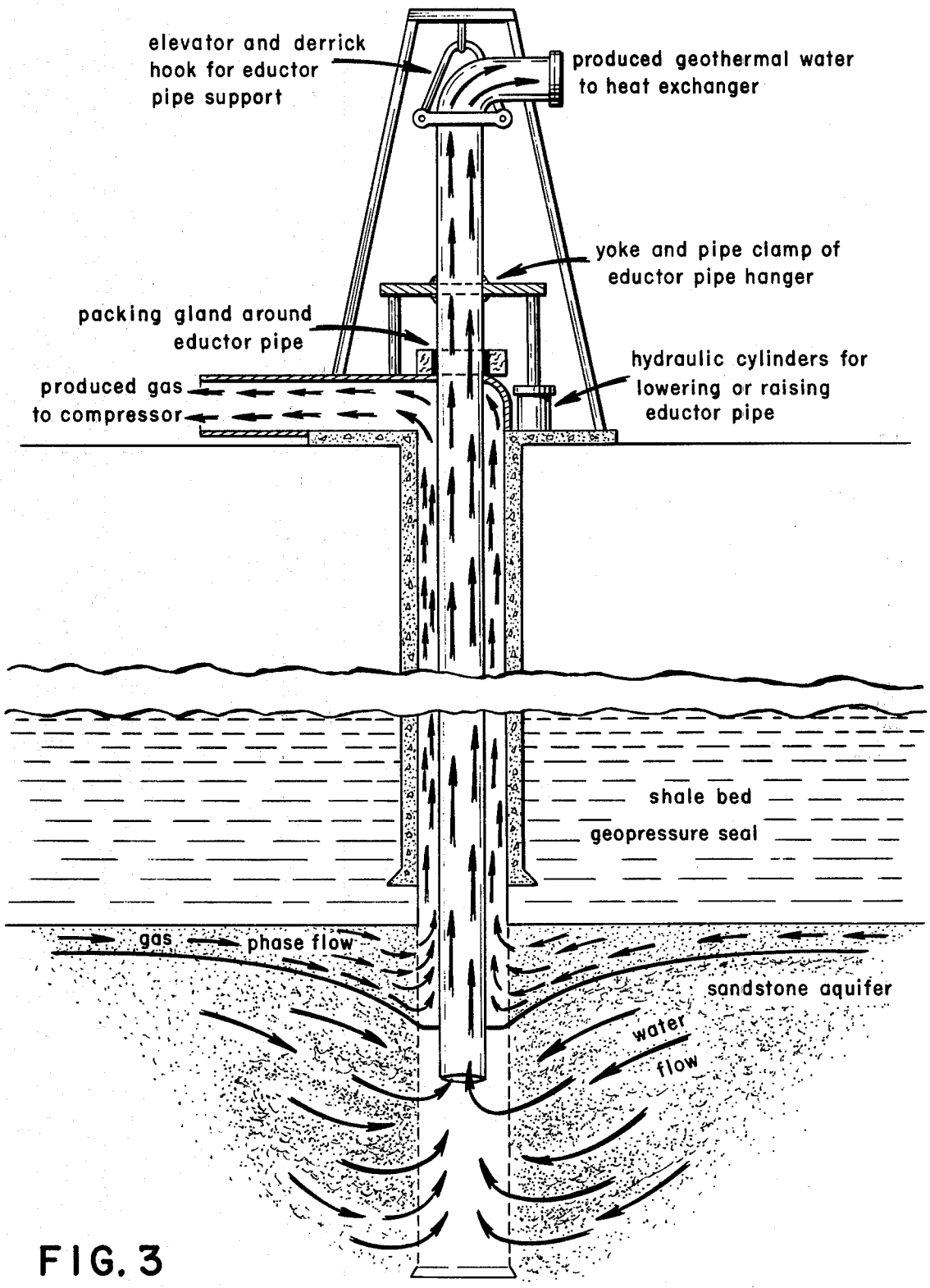
FIG. 3 is the design of a well to produce exsolved gas and geothermal water separately from geopressure zone reservoirs which shows the fluids flow early in the development phase.
Figure 4:
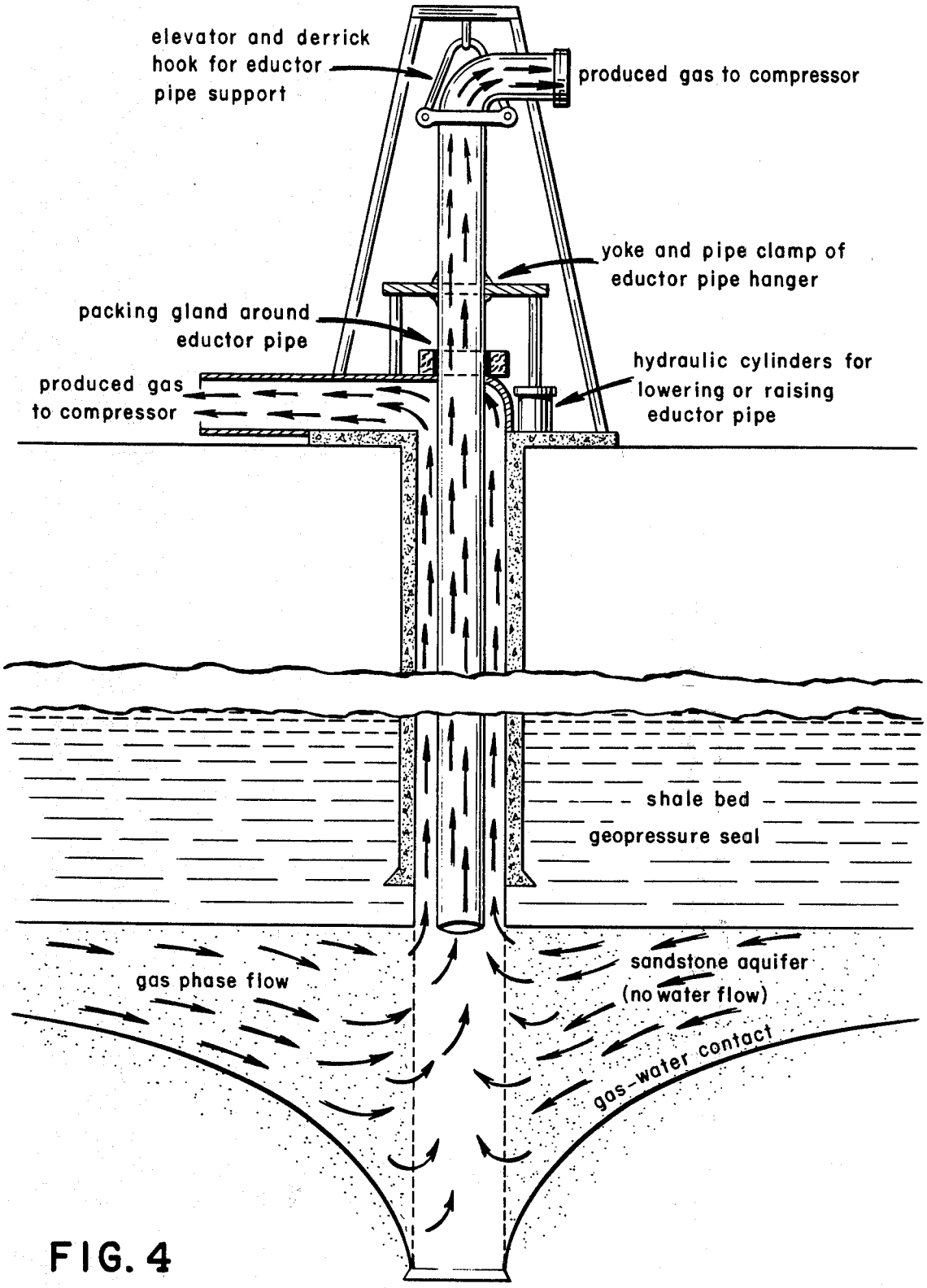
FIG. 4 is the design of a well to produce exsolved gas from geopressure zone reservoirs under maximum gas yield conditions following reversal of the gas/water permeability ratio.

FIGS. 3 and 4 show an idealized typical well design, in accordance with this invention. The eductor pipe is shown supported by an elevator and derrick hook. A yoke and clamp is affixed around the eductor pipe and attached to a hydraulic cylinder which apparatus acts to raise or lower the eductor pipe, as desired. The shown raising and lowering means should be considered as merely illustrative, since any means which can raise and lower the eductor pipe can be used. In FIGS. 3 and 4, the eductor pipe is shown as coaxial with the well bore. This also is merely illustrative, since in practice, well bores are never perfectly vertical or perfectly straight. Although the flow of natural gas will not be substantially affected by the position of the eductor pipe within the well bore, it is preferred that the eductor pipe be approximately centered. This can be accomplished by any conventional placement means, such as the use of centralizers or struts (spacers) directed outward from the outer surface of the eductor pipe to the inner surface of the liner.

In certain circumstances, such as where water flow in the eductor pipe is stopped while gas production continues, it may be critical to thermally insulate the eductor pipe or construct it of an insulating material such that there is minimal heat loss in the water. Similarly, when it is desired to recover the thermal energy of the aquifer waters in accordance with this invention, the eductor pipe should be thermally insulated to prevent heat loss from the geothermal water brought to the well head. The expansion of the natural gas as it rises in the main well bore will cause a considerable absorption of heat. An inadequately insulated eductor pipe may result in sufficient heat loss in the geothermal water so as to render the water useless as a source of geothermal energy. It is even possible that under certain well conditions, such as when the water is stationary, the water is an inadequately insulated eductor pipe will freeze. This may cause a reduction of the gas flow to a level which is not at a sufficient rate to sustain the gas cap.

FIG. 3 illustrates an early development phase of a well drilled into a geopressure zone aquifer reservoir. In a typical well, the aquifer may have a thickness of 300 feet. The initial conditions typically may be a fluid pressure of 10,000 psi, a temperature of 300° F., dissolved solids in the amount 10,000 mg/l, and dissolved methane in the amount 41 cf/bbl.

There may be attic gas in the aquifer, in which case the eductor tube is lowered below the gas/water interface, gas is produced from the annulus, and geothermal water is produced through the eductor pipe. In a geopressure zone aquifer, there will be sufficient pressure to produce the gas and geothermal water without pumping. If there is no initial gas cap, the bottom or inlet end of the eductor pipe is positioned slightly, for example, 10–20 feet, beneath the top of the aquifer, and the annulus and eductor pipe initially both produce geothermal water. The resulting pressure drop in the vicinity of the well will cause gas to exsolve from the aquifer water. Once critical gas saturation is reached, the water/gas permeability is reversed and free gas flows to form a gas cap, as illustrated in FIG. 3. The position of the educator pipe is maintained beneath the gas/water interface, to insure a gas phase flow through the annulus and water flow through the eductor pipe. Once this flow has started, the above initial conditions in the aquifer would be expected to change to, for example, a fluid pressure of 8,000 psi and dissolved methane of 35 cf/bbl, with a gas yield of 6 cf/bbl. The dissolved solids and temperature would remain approximately the same.

As more geothermal water is withdrawn, the gas/water interface (contact) will be lowered—as the gas/water permeability ratio continues to increase—and will take the form of an inverse cone, as illustrated in FIG. 4. At this point, the individual well will be producing at optimum efficiency or maximum yield, and the eductor pipe can be raised so as to permit gas to be produced through both the annulus and the eductor pipe. At this stage, typically, the fluid pressure might be expected to be 6,000 psi, with 29 cf/bbl of dissolved methane and 12 cf/bbl of gas yield. The temperature and dissolved solids of the associated formation water will still remain approximately the same, although there may be a very slight decrease in temperature and increase in the dissolved solids. However, all aquifers may not permit the development of this optimum condition and it may be necessary to continue withdrawal of water through the eductor pipe as shown in FIG. 3 for the entire period of gas production.

As the increasing rate of gas exsolution and production from the well causes the pressure in the aquifer to be reduced, the gas/water interface will tend to flatten. This is detectible at the well head by the appearance of water slugs, forced up by the gaseous pressure. When this occurs, the bottom end of the eductor pipe is again lowered beneath the gas/water interface, and geothermal water is again drawn off, with gas continuing to be produced through the annulus. The gas/water interface is again lowered in the well, and a deep inverse cone is again hopefully formed in the aquifer. The eductor tube can again be raised, and the gas production cycle repeated.

It is believed critical that the fluid (gas and/or liquid) flow from the well be uninterrupted. If the system is shut down for any length of time, then the gas/water interface will rise to the top of the aquifer, and gas production will stop. Although it may be possible to begin gas production again, by repeating the initial stages of the process, this would require greatly reduced aquifer fluid pressure. Production of very large amounts of geothermal water at high rates would be necessary before gas production could be resumed, the gas being exsolved from water having only residual methane saturation, thus making the process less cost effective.

Ideally, the well is used in conjunction with other wells typically located as indicated in FIG. 6, so that the gas/water interface cones of the wells form a mutual interference effect as illustrated in FIG. 7. At this point, the gas/water permeability ratio is reversed throughout the well field, and if the gas (and intermittently, water) are removed at a rate such as to keep the gas/water interface at some predetermined equilibrium depth, optimum gas production efficiency will be achieved.

As mentioned previously, there may be many instances, particularly in connection with hydropressure aquifers, where it is desirable to assist the discharge of water from the aquifer. This is readily accomplished by positioning a submersible pump down hole in the well. Such pumps are well known in oil-field operation. The pump may be integral with the eductor pipe for support therewith as shown in FIG. 5. Another design positions the pump independently within the eductor pipe by supporting it separately from the ground surface as shown in FIG. 8. This arrangement forms in effect a well inside a well, the inner well withdrawing the aquifer waters, using the submersible pump as needed, and the outer well (the annulus) producing the desired natural gas substantially water-free.

It is considered that the arrangement shown in FIG. 8 is preferred for several reasons. Most important, by separately supporting the submersible pump, the depth of the eductor pipe setting within the upper part of the screen, and the depth of the pump setting to achieve optimum aquifer water withdrawal, can be adjusted independently of each other, using separate hanger or elevator systems. A further advantage of separating the pump assembly from the very long and heavy eductor pipe enables the use of standard pump column pipe and eliminates the need for fabrication of the shroud around the pump. As such, all of the materials used in this preferred arrangement are "off the shelf".

As shown in FIG. 8, a typical aquifer at a depth of about 8,000 feet would permit positioning of the submersible pump at about 3,000 feet below the ground surface. Thus, an initial water height of about 3,000 feet above the submersible pump would be established. Once normal operations are established, it is believed that the pumping water level will be about 2,000 feet below the surface. A minimum pump submergence of about 1,000 feet of water is considered necessary in order to provide sufficient hydraulic head to preclude excessive exsolution of natural gas dissolved in the water in the eductor pipe, which might disrupt the pump operation by causing surges in the pumping and potential damage to or destruction of the pump.

As shown in FIG. 8, it is considered preferred to include a back pressure control valve and flow regulator in the gas discharge line from the annulus at the well head. The pressure head of water in the aquifer may tend intermittently to pinch off the formed zone of overlying gas (or gas cap), completely filling the aquifer around the well bore, if the flow of gas from the well through the annulus is open to the atmosphere. Cyclic recovery of gas pressure from the surrounding nearby attic would tend to drive the gas-water interface downward again, causing a new surge of gas flow to reach the well bore.

The control valve and flow regulator in the gas discharge line should act to preserve sufficient partial pressure in the exsolved gas zone at the top of the aquifer to ensure continuous gas flow to the well, preventing intermittent shutoff of flow and/or surges in the gas discharge in a manner known in the art. Continuous gas flow can be maintained if the gas pressure in the well bore is equal to, or slightly greater than, the water pressure in the aquifer adjacent to the well, at a depth several feet above the lower end of the eductor pipe. By using a control valve and flow regulator in the gas discharge line, the rate of gas flow to the well head can be coordinated with the rate of water withdrawal through the eductor pipe to assure smooth operation. The flow regulator can be set to the pressure range necessary to maintain the desired submergence of the eductor pipe intake (bottom) within the screen, and to prevent the gas-water interface in the aquifer from rising above a selected level, say for example, 5 feet below the top of the aquifer. Gas flow back pressure at the well head can be automatically controlled by electrical signals from a pressure transducer installed on the eductor pipe near the bottom, say a few feet above the bottom.

The control valve and flow regulator in the gas discharge line can also be coupled with a water discharge back pressure control system at the well head designed to choke down the pump discharge rate, if an increase in the rate of gas flow to the well resulted in downward coning sufficient to cause gas to enter the eductor pipe. As mentioned above, free gas in the water flow system (inner well) could cause pumping in surges (gas locking of the pump) with severe damage to the pump. In addition or as an alternative, a system to avoid such pump malfunction conditions could be installed on the eductor pipe, consisting of pressure transducers and appropriate relays to the pump controls at the well head.

The geothermal water removed during this process will lose little heat if the eductor pipe is thermally insulated, and can be used as a source of thermal energy at the surface, by directing it to a heat exchanger, or piping it to areas that require hot water heating. Where there is no immediate need for the geothermal energy, the geothermal water can be stored in shallow salt water aquifers in the hydropressure zone. The gas depleted geothermal water should not be pumped back into the gas-producing aquifer; this would alter the gas/water interface equilibrium, delay the desired reversal of the gas/water permeability ratio and reduce the effectiveness of the well-field development plan.

The present invention is well adapted to achieve the objectives and attain the results and advantages described, as well as others inherent therein. While the presently preferred embodiments of the invention are provided for the purpose of disclosure, numerous modifications and changes will readily suggest themselves to those skilled in the art without departing from the scope of the present invention. Accordingly, the present disclosure is considered illustrative, with the scope of the invention being defined by the appended claims.

I claim:

1. A method for producing water-free natural gas and thermal water from geopressure zone and hydropressure zone aquifers containing gas-saturated waters comprising:

(A) drilling a well so that it penetrates an aquifer containing gas-saturated water;

(B) using sand screening means to complete the portion of the well bore penetrating into the aquifer, thus allowing sand-free gas-saturated water to enter the well bore;

(C) inserting a thermally insulated eductor pipe having an open lower intake end into the well bore so as to form an annulus between the outer surface of the eductor pipe and the inner surface of the well bore;

(D) lowering the intake end of the eductor pipe so that it is below the surface of the gas-saturated water in the aquifer;

(E) removing water from the bottom of the well by means of both the annulus and the eductor pipe, thus lowering the pressure in the aquifer and permitting natural gas to exsolve from the gas-saturated water in the vicinity of the well bore, to produce a gas cap;

(F) lowering the eductor pipe further after the gas cap is produced so that its intake end is again beneath the gas/water interface, to permit a continuous gas flow through the annulus and a water flow through the eductor pipe, and (G) maintaining the eductor pipe intake end beneath the gas/water interface.

2. The method of claim 1 wherein the eductor pipe intake end is maintained beneath the gas/water interface until the gas/water permeability ratio is reversed, after which the eductor pipe is raised above the gas/water interface so that gas flows through both the annulus and the eductor pipe.

3. The method of claim 2 wherein the eductor pipe intake end is lowered beneath the gas/water interface whenever the gas/water interface rises sufficiently to interfere with gas flow, so that water flows through the eductor pipe, and the eductor pipe intake end is raised above the gas/water interface after the gas/water interface is lowered sufficiently so as not to interfere with gas flow, so that gas flows through the eductor pipe, the gas flow through the annulus being substantially continuous.

4. The method of claims 1 or 3 wherein the well is drilled into an aquifer having an existing gas cap, comprising the additional step of first removing the gas from the existing cap by means of both the annulus and the eductor pipe until gas-exsolved water enters the well bore, and then lowering the eductor pipe intake end beneath the gas/water interface, to permit water flow through the eductor pipe and continuing gas flow through the annulus.

5. The method of claim 3 wherein a plurality of additional wells of the same type are drilled into the aquifer so that the gas/water interface cones of the wells form a mutual interference effect and the gas/water permeability ratio is reversed throughout the well field, with the gas, and intermittent water, removal at a rate such as to keep the gas/water interface level at equilibrium.

6. The method of claims 1 or 5 wherein the water removed from the well is used at the surface as a source of thermal energy.

7. The method of claim 6 wherein the aquifer is in a geopressure zone.

8. The method of claim 7 wherein the geothermal water is stored in a hydropressure zone aquifer.

9. The method of claim 6 wherein the aquifer is in a hydropressure zone.

10. The method of claim 9 wherein the eductor pipe is modified to incorporate a submersible pump.

11. An apparatus for producing water-free natural gas and thermal water from wells bored into geopressure zone and hydropressure zone aquifers containing gas-saturated water comprising:

(A) a well having sand screening means completing the portion of the well bore penetrating into the aquifer;

(B) an eductor pipe having an open lower intake end, located within and generally coaxial with the well bore, so as to form an annulus between the outer surface of the eductor pipe and the inner surface of the well bore;

(C) control valve means operatively associated with the annulus to control the flow of natural gas from the well through said annulus; and (D) means, operatively associated, for raising and lowering the eductor pipe.

12. The apparatus of claim 11 wherein the well has a conventional liner and casing extending downward from the surface to the point at which the well bore enters the aquifer.

13. An apparatus for producing water-free natural gas and thermal water from wells bored into hydropressure zone aquifers containing gas-saturated water comprising:

(A) a well having sand screening means completing the portion of the well bore penetrating into the aquifer;

(B) an eductor pipe having an open lower intake end, located within and generally coaxial with the well bore, so as to form an annulus between the outer surface of the eductor pipe and the inner surface of the well bore;

(C) control valve means operatively associated with the annulus to control the flow of natural gas from the well through said annulus;

(D) pumping means, operatively associated with the eductor pipe; and (E) means, operatively associated, for raising and lowering the eductor pipe.

14. The apparatus of claim 12 wherein the well has a conventional liner and casing extending downward from the surface to the point at which the well bore enters the aquifer, and the pumping means is a submersible pump located at a point along the eductor pipe beneath the well head.

15. The apparatus of claims 11 or 14 wherein the sand screening means comprises a wire-wrapped perforated pipe in which the wrapping is a wire winding spaced apart so that the slot formed between the windings is sufficient to pass only 70% fines of sand in the aquifer.

16. The apparatus of claims 11 or 14 wherein the eductor pipe is thermally insulated, coated to reduce friction and prevent corrosion, and has a diameter of from about 8 inches to about 10 inches.

17. The apparatus of claims 11 or 14 wherein the raising and lowering means for the eductor pipe comprises an elevator and derrick hook supporting the eductor pipe, and a yoke and clamp affixed around the eductor pipe and connected with a hydraulic cylinder lift.

18. The apparatus of claim 16 wherein the diameter of the well liner is at least 2 inches wider than the diameter of the eductor pipe.

19. The apparatus of claim 18 wherein the eductor pipe is centered within the well by means of spacers directed outward from the outer surface of the eductor pipe to the inner surface of the liner.

20. A method for producing natural gas from geopressure zone and hydropressure zone aquifers containing appreciable quantities of dissolved or dispersed natural gas in the aquifer water in which one or more wells extend from the surface into an aquifer which comprises:

(A) preventing aquifer materials from entering the well bore;

(B) inserting a pipe having an open lower intake end into the well so as to form an annulus between the outer surface of the pipe and the inner surface of the well casing;

(C) positioning the intake end of the pipe so that it is below the gas-water interface in the aquifer;

(D) removing water from the well by means of the pipe to lower the pressure in the aquifer and permit natural gas to exsolve from the water in the vicinity of the well bore as a substantially water-free gas phase; and (E) recovering the natural gas through the annulus.

21. A method for recovering natural gas from an aquifer containing an appropriate quantity of natural gas in which one or more wells are completed from the ground surface to said aquifer which comprises:

extending an eductor pipe having an open lower intake end into at least one well so as to form an annulus between the outer surface of the eductor pipe and the inner surface of the well;

positioning the intake end of the pipe so that it is below the gas-water interface in the aquifer;

withdrawing water from said aquifier through said eductor pipe to lower the pressure in the aquifer to achieve critical gas saturation in said aquifer and permit natural gas to exsolve from the water in the vicinity of the well bore as a substantially water-free gas phase; and allowing free gas to flow to the surface through the annulus.

22. The method of claim 21 wherein said critical gas saturation occurs when sufficient water has been withdrawn from said aquifer that free gas occupies more than at least six percent of the pore space in the upper part of the aquifer.

23. The method of claim 21 wherein the water is withdrawn from said aquifer to reduce the pressure in the aquifer between about 30% and about 50%, in the vicinity of wells and well fields.

24. An apparatus for producing natural gas from geopressure zone and hydropressure zone aquifers containing appreciable quantities of dissolved or dispersed natural gas in which one or more wells extend from the surface into an aquifer which comprises:

(A) means for preventing aquifer materials from entering the well;

(B) an eductor pipe means extending from the surface generally coaxial within the well and having an open lower intake end adapted to extend into said aquifer so as to form an annulus between the outer surface of the eductor pipe means and the inner surface of the well;

(C) control valve means operatively associated with the annulus to control the flow of natural gas from the well through said annulus; and (D) means for raising and lowering the eductor pipe means within the well.

25. The apparatus of claim 24 and also including a submersible pump positioned with respect to said eductor pipe means so as to assist withdrawal of aquifer waters from said aquifer to said surface through said eductor pipe means.

26. The apparatus of claim 25 wherein said submersible pump is positioned in said eductor pipe means so as to establish sufficient static water head above said pump so as to retard exsolution of the dissolved natural gas in the aquifer waters in the eductor pipe means.

27. A system for producing natural gas from geopressure zone and hydropressure zone aquifers containing appreciable quantities of dissolved or dispersed natural gas in the aquifer waters which comprises:

a well extending from the ground surface into the aquifer and having means associated therewith for preventing aquifer materials from entering the well;

an eductor pipe located within and generally coaxial with the well so as to form an annulus between the outer surface of the eductor pipe and inner surface of the well casing;

control valve means operatively associated with the annulus to control the flow of natural gas from the well through said annulus; and means for raising and lowering the eductor pipe so as to position an open lower intake end thereof in the aquifer waters.

28. The system of claim 27 and including a submersible pump operatively associated with the eductor pipe to assist the withdrawal of aquifer waters from the aquifer to the ground surface through said eductor pipe.

29. A method of recovering natural gas from a geopressure natural gas reservoir containing water and appreciable quantities of dissolved and dispersed natural gas and including one or more wells completed in the reservoir, which comprises extending an eductor pipe in each well from the surface to beneath the water level in said aquifer to form an annulus between said pipe and the well wall, producing water from the well through said eductor pipe under reservoir pressure, and continuing to produce water at a high enough rate of production to reduce the existing bottom hole pressure of the wells to effect the recovery of natural gas from the reservoir by causing the natural gas to expand sufficiently so as to migrate more freely to the wells and be produced through said annulus.

30. The method of claim 29 wherein the initial bottom hole pressure of the well is reduced by at least 30–50%.

31. A method for recovering gas from solution in aquifer waters of a hydropressure or geopressured aquifer comprising the steps of:

extending an eductor pipe in a well completed in said aquifer from ground surface into the aquifer waters to form an annulus between said pipe and the well wall;

lifting water from said well through the eductor pipe until the pressure in said aquifer is reduced sufficiently to cause gas initially in solution in said aquifer to exsolve and become mobile and to flow as a gaseous phase to said well, said wells being producible only by lifting; and continuing to produce water from said wells through said eductor pipe to cause gas saturation to build up in excess of that required for gas to flow in gaseous phase to said well, and producing said gaseous phase which has evolved from said water in said aquifer from said well through the annulus.

32. A method as recited in claim 31 in which substantially more gaseous phase gas is produced than could have been held in solution in said produced water, under initial conditions in the aquifer tapped by the well.

33. A method as recited in claim 31 in which said produced gas is separated from said water prior to entry into said well.

34. A method of recovering natural gas from a geopressured aquifer containing water and gas in solution in the water, with or without a zone of free gas dispersed in the water comprising:

providing one or more wells extending from the surface and completed in the geopressure aquifer in said zone, extending an eductor pipe in each well from the ground surface to a depth below the gas/water interface in said aquifer, to form an annulus between said pipe and the well wall, allowing the geopressured aquifer to flow water and natural gas under aquifer pressure through the eductor pipes so as to lower the pressure in the aquifer sufficiently to allow a portion of the free gas dispersed in the water and a portion of the gas in solution to be released from the water whereby the released natural gas will migrate more freely to the well and be produced through said annulus.

35. The method of claim 34 wherein, the existing bottom hole pressure in said wells is reduced by at least from about 30% to about 50%.

36. A method of recovering natural gas from a geopressured aquifer containing water and gas in solution in the water in a zone of free gas dispersed in the water comprising:

providing one or more wells extending from the surface and completed in the geopressured aquifer in said zone, extending an eductor pipe in each well from the surface to beneath the gas/water interface in said aquifer to form an annulus between said pipe and the well wall, and producing water from the well or wells to obtain a low bottom hole working pressure in said wells to cause a portion of the free gas dispersed in the water and a portion of the gas in solution to be released from the water whereby the released natural gas will migrate more freely to the well and be produced through said annulus.

* * * * *